US007891785B2

(12) United States Patent
Yazaki

(10) Patent No.: US 7,891,785 B2
(45) Date of Patent: Feb. 22, 2011

(54) LIQUID JET HEAD AND A LIQUID JET APPARATUS

(75) Inventor: Shiro Yazaki, Chino (JP)

(73) Assignee: Seiko Epson Corporation, Shinjuku-ku, Tokyo (JP)

( * ) Notice: Subject to any disclaimer, the term of this patent is extended or adjusted under 35 U.S.C. 154(b) by 164 days.

(21) Appl. No.: 12/396,405

(22) Filed: Mar. 2, 2009

(65) Prior Publication Data

US 2009/0231396 A1 Sep. 17, 2009

(30) Foreign Application Priority Data

Mar. 3, 2008 (JP) ..... 2008-052702
Jan. 8, 2009 (JP) ..... 2009-002957

(51) Int. Cl.
*B41J 2/045* (2006.01)

(52) U.S. Cl. ..... 347/71

(58) Field of Classification Search ..... 347/71, 347/68–70, 72; 400/124.14, 124.16; 310/311, 310/324, 327
See application file for complete search history.

(56) References Cited

U.S. PATENT DOCUMENTS

2006/0250456 A1* 11/2006 Matsuzawa et al. ..... 347/68
2007/0035589 A1* 2/2007 Takahashi et al. ..... 347/68
2008/0012907 A1* 1/2008 Takahashi ..... 347/68
2008/0170107 A1* 7/2008 Li ..... 347/71

FOREIGN PATENT DOCUMENTS

JP 2005-088441 A 4/2005

* cited by examiner

*Primary Examiner*—K. Feggins
(74) *Attorney, Agent, or Firm*—Kilpatrick Townsend & Stockton LLP

(57) ABSTRACT

An upper surface of a piezoelectric layer in an area opposed to a pressure generating chamber and a side surface of the piezoelectric layer in an arrangement direction of the piezoelectric elements are covered with an upper electrode. In addition, on one end in a longitudinal direction of the piezoelectric element, the piezoelectric layer extends up to an adhesive area of a flow passage forming substrate to which a circumferential portion of a piezoelectric element preserver of a joining substrate is adhered, and the lower electrode extends up to the outside of an end portion of the piezoelectric layer to form a terminal section in an end portion of the lower electrode.

5 Claims, 5 Drawing Sheets

LIQUID JET HEAD AND A LIQUID JET APPARATUS

CROSS REFERENCE TO RELATED APPLICATIONS

This application claims priority to Japanese Patent Application No. 2008-52702, filed Mar. 3, 2008 and Japanese Patent Application No. 2009-2957, filed Jan. 8, 2009. The entire disclosures of the aforementioned applications are incorporated by reference herein.

BACKGROUND OF THE INVENTION

1. Field of the Invention

The present invention relates to a liquid jet head and a liquid jet apparatus.

2. Description of Related Art

A piezoelectric element used for an ink jet printing head as a representative example of a liquid jet head ejecting liquid droplets has a problem that the piezoelectric element is easily broken down due to an outside environment such as humidity. In order to solve this problem, a piezoelectric element in which the outer circumferential surface of a piezoelectric layer is covered with an upper electrode is disclosed in JP-A-2005-88441, for example. However, the piezoelectric layer can be prevented from being broken down due to humidity by covering the piezoelectric layer with the upper electrode. However, since the upper electrode formed on the end surface of the piezoelectric layer is very close to a lower electrode, a problem may occur in that dielectric breakdown occurs between both the electrodes and thus the piezoelectric element is broken down.

SUMMARY OF THE INVENTION

The invention is devised in order to solve at least some of the above-mentioned problems and can be embodied as the following aspects or applied examples.

According to an aspect of the invention, there is provided a liquid jet head including: a flow passage forming substrate in which a plurality of pressure generating chambers individually communicating with nozzles for ejecting liquid droplets are arranged in parallel; piezoelectric elements which are formed on one surface of the flow passage forming substrate and each includes a lower electrode, a piezoelectric layer, and an upper electrode; and a joining substrate which is adhered onto the one surface of the flow passage forming substrate by an adhesive and includes a piezoelectric element preserver which is a space ensuring that drive of the piezoelectric element is not interrupted. Each of the lower electrodes is independently provided in correspondence to the pressure generating chamber to serve as an individual electrode of the piezoelectric element. The upper electrode is continuously formed in an arrangement direction of the pressure generating chambers to serve as a common electrode of the piezoelectric elements. The lower electrode in the area opposed to the pressure generating chamber is formed so as to have a width narrower than a width of the pressure generating chamber, and an upper surface and an end surface of the lower electrode in an area corresponding to the pressure generating chamber are covered with the piezoelectric layer. An upper surface of the piezoelectric layer in the area opposed to the pressure generating chamber and a side surface of the piezoelectric layer in an arrangement direction of the piezoelectric elements are covered with the upper electrode. On one end in a longitudinal direction of the piezoelectric element, the piezoelectric layer extends up to an adhesive area of the flow passage forming substrate to which a circumferential portion of the piezoelectric element preserver of the joining substrate is adhered, and the lower electrode extends up to the outside of an end portion of the piezoelectric layer to form a terminal section in an end portion of the lower electrode.

The features other than the above aspects and objects of the invention are apparent from the description of the specification with reference to the accompanying drawings.

BRIEF DESCRIPTION OF THE DRAWINGS

In order to fully understand the invention and the advantages of the invention, the following description and the accompanying drawings will be referred together.

DESCRIPTION OF THE PREFERRED EMBODIMENTS

Figure 1:
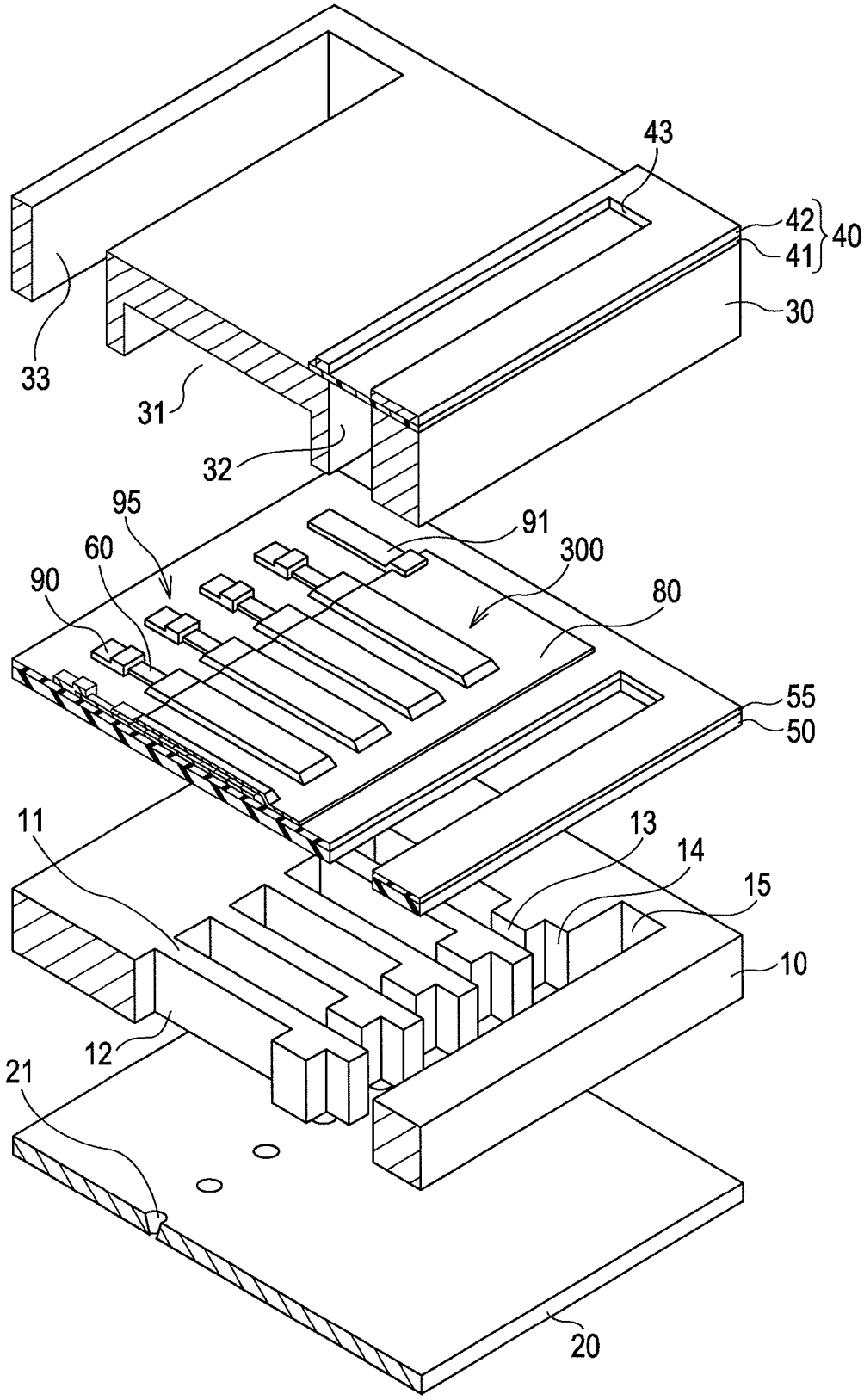
FIG. 1 is an exploded perspective view illustrating a printing head according to an embodiment of the invention.

At least the following aspects are apparent from the description of the specification and the description of the accompanying drawings.

According to an aspect of the invention, there is provided a liquid jet head including: a flow passage forming substrate in which a plurality of pressure generating chambers individually communicating with nozzles for ejecting liquid droplets are arranged in parallel; piezoelectric elements which are formed on one surface of the flow passage forming substrate and each includes a lower electrode, a piezoelectric layer, and an upper electrode; and a joining substrate which is adhered onto the one surface of the flow passage forming substrate by an adhesive and includes a piezoelectric element preserver which is a space ensuring that drive of the piezoelectric element is not interrupted. Each of the lower electrodes is independently provided in correspondence to the pressure generating chamber to serve as an individual electrode of the piezoelectric element. The upper electrode is continuously formed in an arrangement direction of the pressure generating chambers to serve as a common electrode of the piezoelectric elements. The lower electrode in the area opposed to the pressure generating chamber is formed so as to have a width narrower than a width of the pressure generating chamber, and an upper surface and an end surface of the lower electrode in an area corresponding to the pressure generating chamber are covered with the piezoelectric layer. An upper surface of the piezoelectric layer in the area opposed to the pressure generating chamber and a side surface of the piezoelectric layer in an arrangement direction of the piezoelectric elements are covered with the upper electrode. On one end in a longitudinal direction of the piezoelectric element, the piezoelectric layer extends up to an adhesive area of the flow passage forming substrate to which a circumferential portion of the piezoelectric element preserver of the joining substrate is adhered, and the lower electrode extends up to the outside of an end portion of the piezoelectric layer to form a terminal section in an end portion of the lower electrode.

With such a configuration, since the adhesive is present between the exposed portion of the lower electrode and the exposed portion of the upper electrode, the exposed portion of the lower electrode and the exposed portion of the upper electrode are insulated from each other by the adhesive. Accordingly, it is possible to prevent the piezoelectric element from being broken down due to dielectric breakdown occurring between the lower electrode and the upper electrode.

It is preferable that on the other end in the longitudinal direction of the piezoelectric element, the end portion of the lower electrode is covered with the piezoelectric layer. With such a configuration, it is possible to further prevent the dielectric breakdown occurring between the lower electrode and the upper electrode.

It is preferable that the adhesive is an adhesive having an insulating property. With such a configuration, the exposed portion of the lower electrode and the exposed portion of the upper electrode are more surely insulated from each other by the adhesive.

It is preferable that the terminal section is formed as a mounting electrode connected to the lower electrode, and the lower electrode and the mounting electrode are connected to the adhesive area or the outside of the adhesive area. With such a configuration, since the lower electrode is not exposed inside the piezoelectric element preserver, it is possible to more surely prevent the piezoelectric element from being broken down due to dielectric breakdown occurring between the lower electrode and the upper electrode.

According to another aspect of the invention, there is provided a liquid jet apparatus comprising the liquid jet head having the above-described configuration. According to this aspect, it is possible to realize the reliable liquid jet apparatus having the liquid jet head improved in durability.

Hereinafter, exemplary embodiments of the invention will be described with reference to the drawings. The embodiments described below are just described as examples of the invention and all constituent elements described below are not essential constituent elements of the invention.

Preferred Embodiment

Hereinafter, the embodiments will be described with reference to the drawings.

First Embodiment

Hereinafter, the embodiment of the invention will be described in detail.

Figure 2:
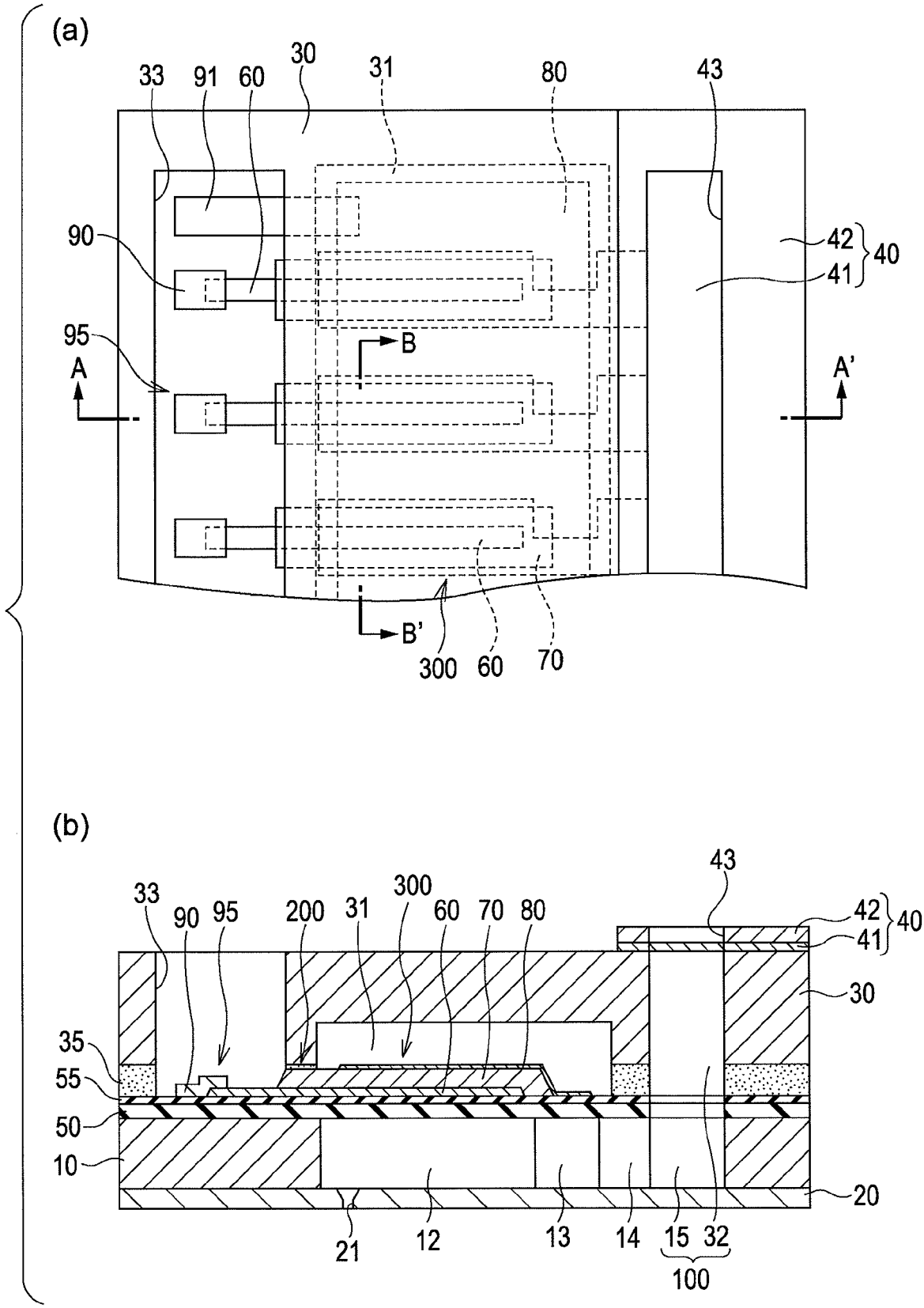
FIG. 2 is a plan view and a sectional view illustrating the printing head according to the embodiment of the invention.

FIG. 1 is an exploded perspective view illustrating the general configuration of the ink jet printing head as an example of a liquid jet head according to an embodiment of the invention. FIG. 2 is a plan view of FIG. 1 and a sectional view taken along the line A-A' thereof.

Figure 3:
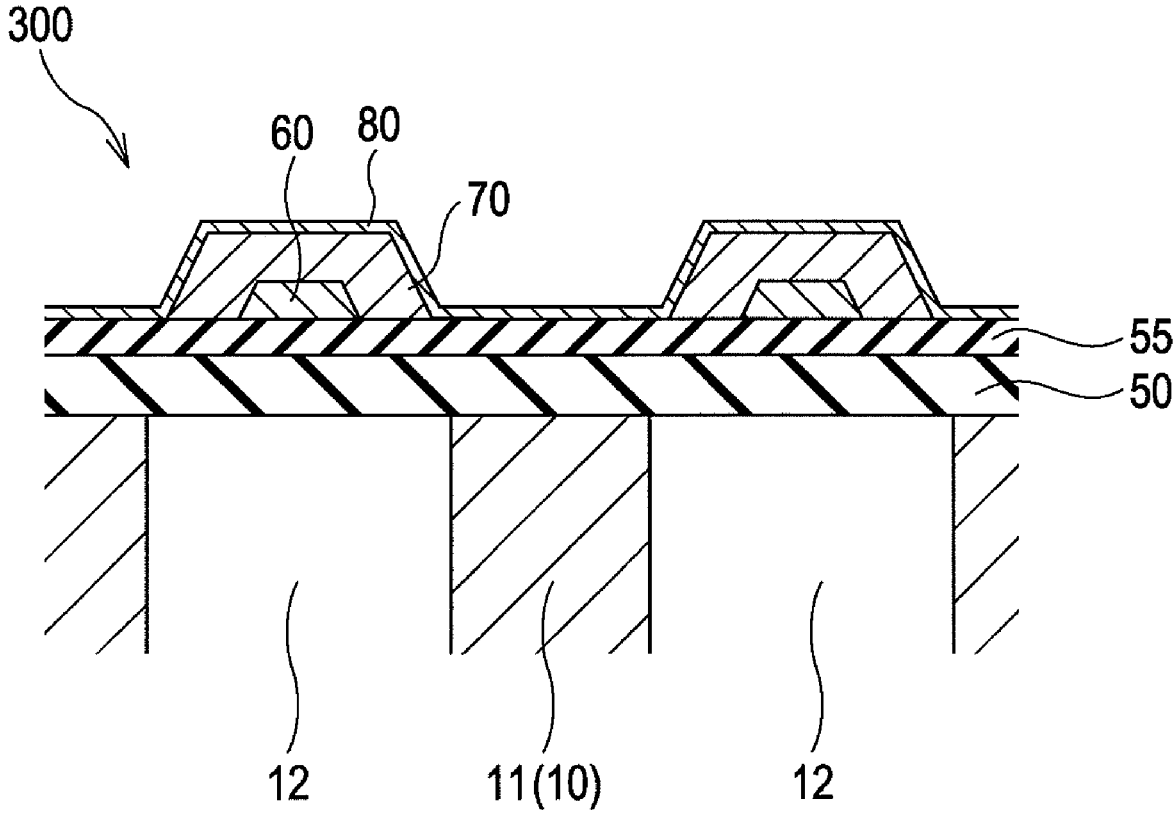
FIG. 3 is a sectional view illustrating major constituent elements of the printing head according to the embodiment of the invention.

FIG. 3 is an expanded view illustrating a piezoelectric element taken along the line B-B' of FIG. 2.

As illustrated, a flow passage forming substrate 10 is formed of a silicon single crystal substrate having a crystal plane direction (110) in this embodiment. An elastic film 50 formed of an oxide film is formed on one surface of the flow passage forming substrate. A plurality of pressure generating chambers 12 which are partitioned by a plurality of partition walls 11 and of which one surface is formed by the elastic film 50 are arranged in parallel in the flow passage forming substrate 10 in the width direction.

In the flow passage forming substrate 10, ink supply passages 13 and communication passages 14 partitioned by the partition walls 11 and individually communicating with the pressure generating chambers 12 are provided on one ends in a longitudinal direction of the pressure generating chambers 12. A communication section 15 communicating with the communication passages 14 is formed outside the communication passages 14. The communication section 15 communicates with a reservoir section 32 of a joining substrate 30, which is described below, to form a part of a reservoir 100 serving as a common ink chamber (liquid chamber) of the pressure generating chambers 12.

Here, the ink supply passage 13 is formed so as to have a cross-section area narrower than that of the pressure generating chamber 12 and uniformly maintains ink flow resistance flowing from the communication section 15 to the pressure generating chamber 12. For example, the ink supply passage 13 is formed so as to have a width narrower than the width of the pressure generating chamber 12 by narrowing a flow passage between the reservoir 100 and the pressure generating chamber 12 on the side of the pressure generating chamber 12. In this embodiment, the ink supply passage is formed by narrowing the width of the flow passage on one side, but the ink supply passage may be formed by narrowing the width of the flow passage on both sides. Alternatively, the ink supply passage may be formed not by narrowing the width of the flow passage but by narrowing the thickness thereof in a thickness direction of the ink supply passage. In addition, each of the communication passages 14 is formed by extending the partition walls 11 on both the ends in the width direction of the pressure generating chamber 12 toward the communication section 15 and partitioning a space between the ink supply passage 13 and the communication section 15.

In this embodiment, a silicon single crystal substrate is used as a material of the flow passage forming substrate 10, but the invention is not limited thereto. For example, glass ceramics, stainless steel, or the like may be used.

A nozzle plate 20 having nozzles 21 punched therethrough and individually communicating with the vicinities of the ends of the pressure generating chambers 12 opposite the ink supply passages 13 is fixed and adhered to an opening surface of the flow passage forming substrate 10 by an adhesive or a heat welding film. The nozzle plate 20 is formed of glass ceramics, a silicon single crystal substrate, stainless steel, or the like.

On the other hand, the above-described elastic film 50 is formed opposite the opening surface of the flow passage forming substrate 10, and an insulating film 55 formed of an oxide film different from the material of the elastic film 50 is formed on the elastic film 50. Piezoelectric elements 300 each including a lower electrode film 60, a piezoelectric layer 70, and an upper electrode film 80 are formed on the insulating film 55. Some piezoelectric elements 300 include the lower electrode film 60, the piezoelectric layer 70, and the upper electrode film 80. Some piezoelectric elements include at least the piezoelectric layer 70. In general, one electrode of the piezoelectric element 300 serves as a common electrode and the other electrode thereof is patterned along with the piezoelectric layer 70 in each of the pressure generating chambers 12 to serve as an individual electrode. Here, the piezoelectric element 300 and a vibrating plate displaced by the drive of the piezoelectric element 300 are altogether called an actuator. In this embodiment, the elastic film 50, the insulating film 55, and the lower electrode film 60 operate as the vibrating plate. However, the elastic film 50 and the insulating film 55 may not be provided and only the lower electrode film 60 may be provided, so that the lower electrode film 60 operates as the vibrating plate. Alternatively, the piezoelectric element 300 may practically operate as the vibrating plate.

The joining substrate 30 having a piezoelectric element preserver 31 which is a space ensuring that the drive of the piezoelectric element 300 is not interrupted is adhered onto the flow passage forming substrate 10 by an adhesive 35. The piezoelectric element preserver 31 is configured to prevent the air from invading into the inside of the piezoelectric element preserver 31. That is, the piezoelectric element preserver 31 is not required to be sealed airtightly, when the piezoelectric element preserver can prevent the air from invading. Accordingly, since the piezoelectric elements 300 are formed inside the piezoelectric element preserver 31, the piezoelectric elements are protected so as not to be affected by the outside environment.

Hereinafter, the structure of the piezoelectric element 300 according to this embodiment will be described in detail. As shown in FIG. 2, the lower electrode film 60 included in the piezoelectric element 300 is formed so as to have the width narrower than the width of the pressure generating chamber 12 in each area opposed to each of the pressure generating chambers 12. The lower electrode film serves as the individual electrode of the piezoelectric element 300. On one end in a longitudinal direction of the piezoelectric element 300, the lower electrode film 60 extends up to the outside of the end portion of the pressure generating chamber 12. On the other end in the longitudinal direction of the piezoelectric element 300, the end portion of the lower electrode film 60 is located inside the pressure generating chamber 12.

The piezoelectric layer 70 is formed so as to have a width wider than the width of the lower electrode film 60 and narrower than the width of the pressure generating chamber 12. The piezoelectric layer 70 extends up to the outside of the end portion of the pressure generating chamber 12 in the longitudinal direction of the piezoelectric element 300 and completely covers the upper surface and the end surface of the lower electrode film 60 in an area opposed to the pressure generating chamber 12. Accordingly, in this embodiment, the end portion and the lower electrode film 60 located inside the pressure generating chamber 12 on the other end in the longitudinal direction of the piezoelectric element 300 is completely covered with the piezoelectric layer 70.

The end portion of the lower electrode film 60 on the other end in the longitudinal direction of the piezoelectric element 300 may be located outside the pressure generating chamber 12. With such a configuration, the piezoelectric layer 70 may be formed so as to cover the upper surface and the end surface of the lower electrode film 60 in the area opposed to the pressure generating chamber 12, but is preferably formed so as to cover the end portion of the lower electrode film 60.

On one end in the longitudinal direction of the piezoelectric element 300, the piezoelectric layer 70 extends up to an adhesive area 200 of the flow passage forming substrate 10 to which the circumferential portion of the piezoelectric element preserver 31 of the joining substrate 30 is adhered. In particular, it is preferable that the piezoelectric layer extends up to the outside of the adhesive area 200.

Figure 4:
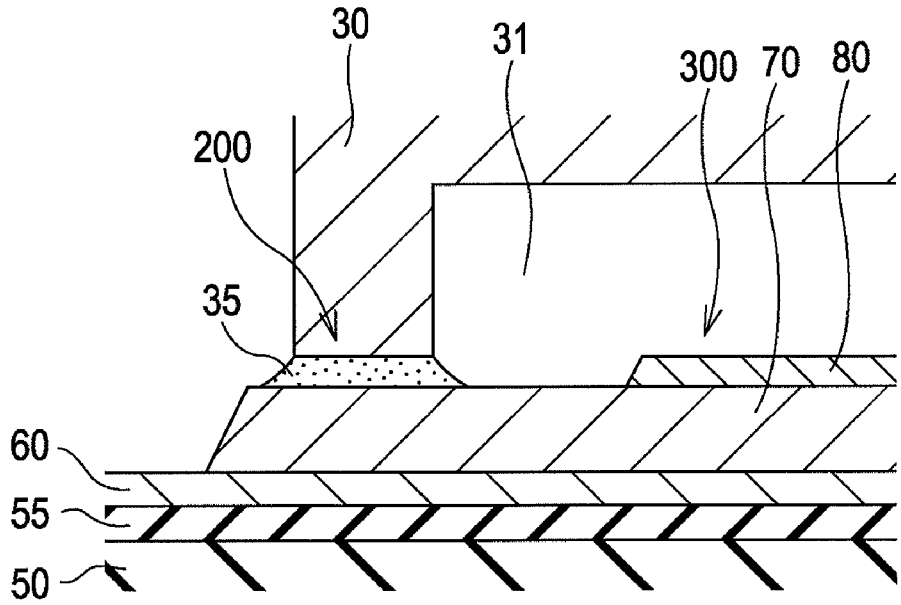
FIG. 4 is an expanded sectional view illustrating the printing head according to the embodiment of the invention.
Figure 5:
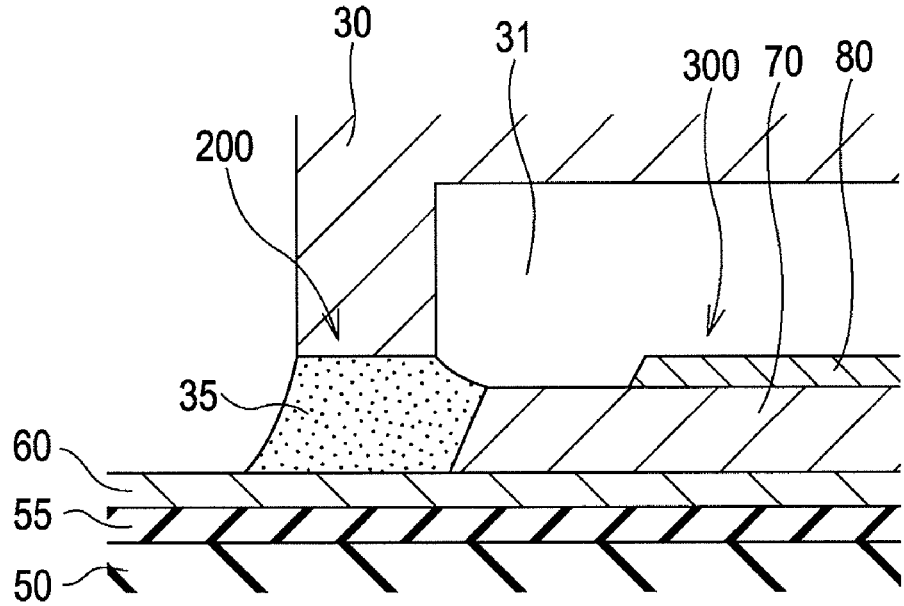
FIG. 5 is an expanded sectional view illustrating the printing head related to the embodiment of the invention according to a modified example.

Here, "the adhesive area 200" means an area where the adhesive 35 is spread to adhere the joining substrate 30 to the flow passage forming substrate 10. That is, the piezoelectric layer 70 is not required to be interposed between the flow passage forming substrate 10 and the joining substrate 30. At least the end surface of the piezoelectric layer may be in contact with the adhesive 35. For example, as shown in FIG. 4, the end portion of the piezoelectric layer 70 extends up to the outside of the adhesive area 200 in this embodiment. However, as shown in FIG. 5, the piezoelectric layer 70 may be formed inside the piezoelectric element preserver 31, as long as the end portion thereof is in contact with the adhesive 35.

The lower electrode film 60 additionally extends outside the piezoelectric layer 70 extending up to the adhesive area 200. In the end portion of the lower electrode film 60, there is formed a terminal section 95 to which a mounting electrode 90 made of gold (Au), for example, is connected and a connection wire (not shown) formed of a bonding wire or the like is connected. That is, the lower electrode film 60 and the mounting electrode 90 are connected to each other not in the inside of the piezoelectric element preserver 31 but in the adhesive area 200 or the outside of the adhesive area 200. In addition, voltage is selectively applied to the piezoelectric elements 300 through the terminal sections 95 (the mounting electrode 90).

The upper electrode film 80 is continuously formed in the area opposed to the plurality of pressure generating chambers 12. On one end in the longitudinal direction of the piezoelectric element, the end portion of the upper electrode film 80 is located inside the area opposed to the pressure generating chamber 12. On the other end in the longitudinal direction of the piezoelectric element 300, the end portion of the upper electrode film 80 is located outside the pressure generating chamber 12. In the upper electrode film 80, the upper surface of the piezoelectric layer 70 in the area opposed to the pressure generating chamber 12 and the side surface (the end surface) of the piezoelectric layer in an arrangement direction of the piezoelectric elements 300 are covered with the upper electrode. That is, the width of the piezoelectric layer 70 is gradually wider on the side of the lower electrode film 60 so that the side surface of the piezoelectric layer 70 is formed as an inclined surface. In addition, the upper electrode film 80 is formed to cover the side surface of the piezoelectric layer 70 in the area opposed to the pressure generating chamber 12 (see FIG. 3). In this embodiment, the side surface of the piezoelectric layer 70 on the other end in the longitudinal direction of the piezoelectric element 300 is also covered with the upper electrode film 80.

The upper electrode film 80 is practically formed only inside the piezoelectric element preserver 31. Actually, the upper electrode film 80 is formed only inside the piezoelectric element preserver 31. However, a mounting electrode 91 connected to the upper electrode film 80 extend up to the outside of the piezoelectric element preserver 31. Like the lower electrode film 60, the front end portion of the mounting electrode 91 is formed as the terminal section 95 connected to the connection wire (not shown). That is, the upper electrode film 80 is formed inside the piezoelectric element preserver 31, except for the terminal section 95.

With such a configuration, the lower electrode film 60 is exposed only outside the piezoelectric element preserver 31. On the other hand, the upper electrode film 80 is exposed only inside the piezoelectric element preserver 31. Therefore, the adhesive 35 for adhering the joining substrate 30 to the flow passage forming substrate 10 is present between the exposed portion of the lower electrode film 60 and the exposed portion of the upper electrode film 80. With such a configuration, the lower electrode 60 and the upper electrode film 80 is insulated by the adhesive 35. Accordingly, the piezoelectric element 300 can be prevented from being broken down due to dielectric breakdown occurring between the lower electrode film 60 and the upper electrode film 80.

It is preferable that the adhesive 35 for adhering the joining substrate 30 and the flow passage forming substrate 10 is an insulating adhesive in order to accomplish insulation between the upper electrode film 80 and the lower electrode film 60. Accordingly, it is possible to surely insulate the lower electrode film 60 and the upper electrode film 80 from each other.

Since the surface of the piezoelectric layer 70 is covered with the upper electrode film 80, it is possible to prevent moisture (humidity) in the air from invading into the piezoelectric layer 70 without additionally providing a protective film. Since a protective film is not required, manufacturing cost is considerably reduced. Moreover, since the piezoelectric element 300 (the piezoelectric layer 70) can be prevented from being broken down due to moisture (humidity), it is possible to improve the durability of the piezoelectric element 300.

In this embodiment, as described above, the end portion of the upper electrode film 80 on one end in the longitudinal direction of the piezoelectric element 300 is located inside the area opposed to the pressure generating chamber 12. In addition, a practical driving unit of the piezoelectric element 300 is provided inside the area opposed to the pressure generating chamber 12. That is, in the piezoelectric element 300, a portion between the end portion of the lower electrode film 60 located inside the pressure generating chamber 12 and the end portion of the upper electrode film 80 is configured as the practical driving unit. With such a configuration, even when the piezoelectric element 300 is driven, great deformation does not occur in the vibrating plate (the elastic film 50 and the insulating film 55) in the vicinity of both the ends in the longitudinal direction of the pressure generating chamber 12. Accordingly, it is possible to prevent crack from occurring in the vibrating plate of this portion.

The joining substrate 30 is provided with the reservoir section 32 in the area opposed to the communication section 15 of the flow passage forming substrate 10. In this embodiment, the reservoir section 32 is formed through the joining substrate 30 in the thickness direction and formed in an arrangement direction of the pressure generating chambers 12. In addition, the reservoir section communicates with the communication section 15 of the flow passage forming substrate 10 to form the reservoir 100 which is the common ink chamber of the pressure generating chambers 12.

A through-hole 33 perforated through the joining substrate 30 in the thickness direction is formed in an opposite area of the reservoir section 32 of the piezoelectric element preserver 31 of the joining substrate 30. The above-described lower electrode film 60 and the terminal section 95 of the upper electrode film 80 are formed inside the through-hole 33. Even though not illustrated, the lower electrode film 60 and each terminal section 95 of the upper electrode film 80 are connected to a driving IC for driving the piezoelectric element 300 through a connection wire extending to the inside of the through-hole 33.

The joining substrate 30 is made of a material such as glass, ceramics, metal, or resin, but it is preferable that the joining substrate is made of a material having the substantially same thermal expansibility as that of the flow passage forming substrate 10. In this embodiment, the silicon single crystal substrate as the same material of the flow passage forming substrate 10 is used.

A compliance substrate 40 including a sealing film 41 and a fixing plate 42 is additionally joined to the joining substrate 30. The sealing film 41 is made of a material having a low rigidity and a flexible property. One surface of the reservoir section 32 is sealed by the sealing film 41. The fixing plate 42 is made of a material such as metal having a hard property. Since an area opposed to the reservoir 100 of the fixing plate 42 is configured as an opening 43 completely removed in the thickness direction, one surface of the reservoir 100 is sealed only by the sealing film 41 having a flexible property.

In the ink jet printing head according to this embodiment, ink is supplied from external ink supply means (not shown), the inside from the reservoir 100 to the nozzles 21 is filled with the ink, and ink droplets are ejected from the nozzles 21 by applying voltage to the piezoelectric elements 300 individually corresponding to the pressure generating chambers 12 in accordance with a print signal supplied from a driving IC (not shown), deforming the piezoelectric elements 300 in a bending manner, and increasing the pressure of the respective pressure generating chambers 12.

The embodiment of the invention has been described, but the invention is not limited to the above-described embodiment.

Figure 6:
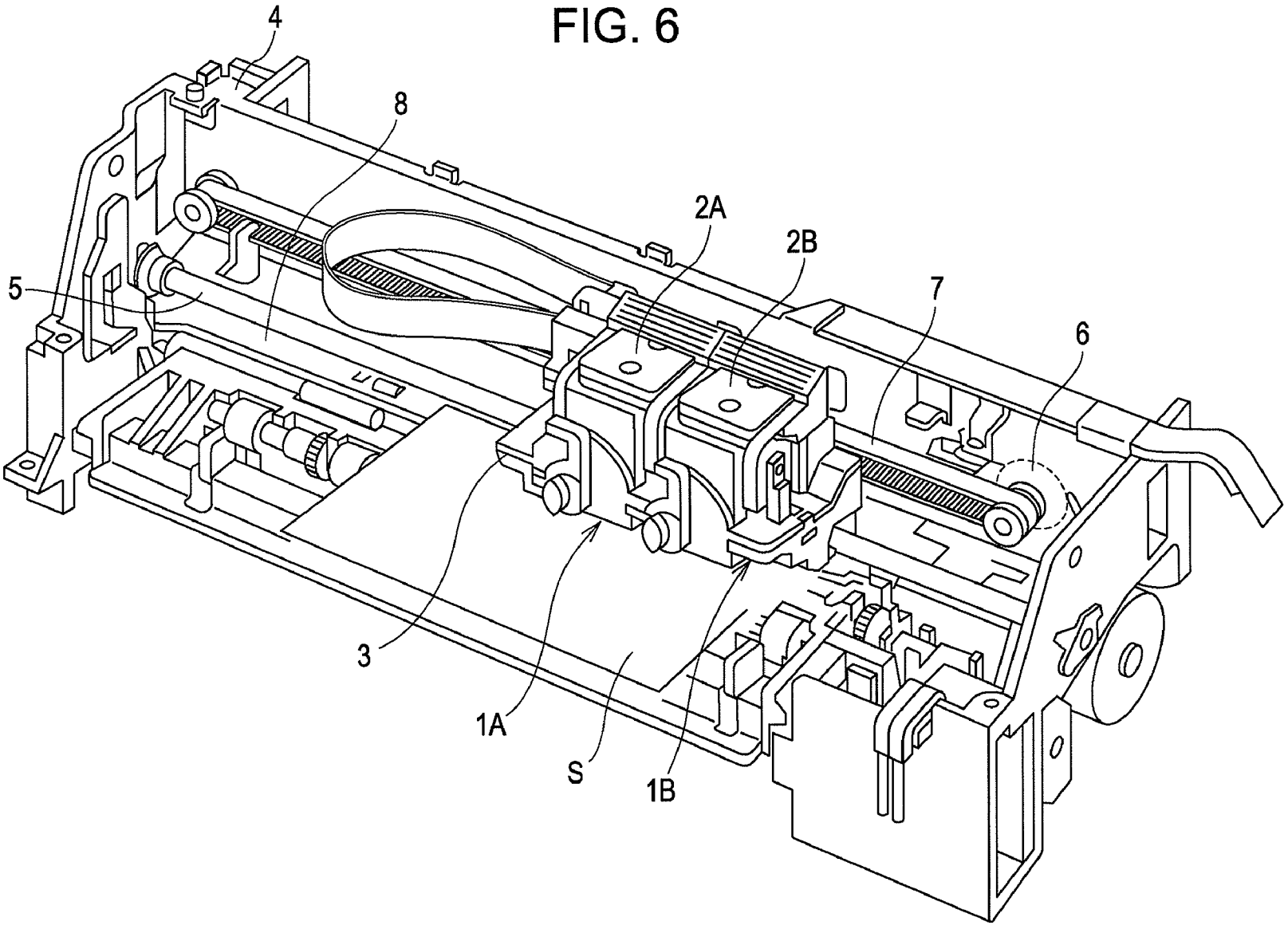
FIG. 6 is a schematic view illustrating a printing apparatus according to the embodiment.

The ink jet printing head according to the above-described embodiment forms a part of a printing head unit having an ink passage communicating with an ink cartridge and the like and is mounted on an ink jet printing apparatus. FIG. 6 is a schematic diagram illustrating an example of the ink jet printing apparatus. As shown in FIG. 6, printing head units 1A and 1B each including an ink jet printing head are provided such that cartridges 2A and 2B forming ink supply means are detachably mounted. A carriage 3 mounted with the printing head units 1A and 1B is provided to freely move along a carriage shaft 5 mounted on an apparatus main body 4 in a shaft direction. The printing head units 1A and 1B are each configured to eject black ink and color ink, for example. The carriage 3 mounting the printing head units 1A and 1B is moved along the carriage shaft 5 by delivering a driving force of a driving motor 6 to the carriage 3 through a plurality of toothed-gears (not shown) and a timing belt 7. On the other hand, a platen 8 is formed along the carriage shaft 5 in the apparatus main body 4. In addition, a printing sheet S as a printing medium such as a paper sheet fed by a sheet feeding roller or the like (not shown) is wound by the platen 8 so as to be transported.

In the above-described embodiment, the ink jet printing apparatus in which the ink jet printing head mounted on the carriage is moved in a main scanning direction has been described, but the invention is applicable to other ink jet printing apparatuses. For example, the invention is also applicable to a line type ink jet printing apparatus which has a plurality of ink jet printing heads and performs printing just by transporting a print sheet S such as a paper sheet in a sub-scanning direction.

In the above-described embodiment, the ink jet printing head and the ink jet printing apparatus have been described as examples of the liquid jet head and the liquid jet apparatus of the invention, respectively. The basic configuration of the liquid jet head and the liquid jet apparatus are not limited to the above-described configuration. The invention is devised so as to be broadly applied to various liquid jet heads and various liquid jet apparatuses including the liquid jet head. Of course, the invention is applicable to a liquid jet head or a liquid jet apparatus ejecting a liquid other than ink. Examples of the liquid jet head include various printing heads used for an image printing apparatus such as a printer, a color material jet head used to manufacture a color filter such as a liquid crystal display, an electrode material jet head used to form electrodes such as an organic EL display or an FED (Field Emission Display), and a bio organism jet head used to manufacture a bio chip.

The invention claimed is:

1. A liquid jet head comprising:

a flow passage forming substrate in which a pressure generating chamber communicating with a nozzle for ejecting liquid droplets;

a piezoelectric element which is formed above one surface of the flow passage forming substrate and each includes a lower electrode, a piezoelectric layer, and an upper electrode; and a joining substrate which is adhered onto the one surface of the flow passage forming substrate by an adhesive and includes a piezoelectric element preserver which is a space ensuring that drive of the piezoelectric element is not interrupted, wherein each of the lower electrodes is independently provided in correspondence to the pressure generating chamber to serve as an individual electrode of the piezoelectric element, wherein the upper electrode is continuously formed in an arrangement direction of the pressure generating chambers to serve as a common electrode piezoelectric elements, wherein the lower electrode in the area opposed to the pressure generating chamber is formed so as to have a width narrower than a width of the pressure generating chamber, and an upper surface and an end surface of the lower electrode in an area corresponding to the pressure generating chamber are covered with the piezoelectric layer, wherein an upper surface of the piezoelectric layer in the area opposed to the pressure generating chamber and a side surface of the piezoelectric layer in an arrangement direction of the piezoelectric elements are covered with the upper electrode, and wherein on one end in a longitudinal direction of the piezoelectric element, the piezoelectric layer extends up to an adhesive area of the flow passage forming substrate to which a circumferential portion of the piezoelectric element preserver of the joining substrate is adhered, and the lower electrode extends up to the outside of an end portion of the piezoelectric layer to form a terminal section in an end portion of the lower electrode.

2. The liquid jet head according to claim 1, wherein on the other end in the longitudinal direction of the piezoelectric element, the end portion of the lower electrode is covered with the piezoelectric layer.

3. The liquid jet head according to claim 1, wherein the adhesive is an adhesive having an insulating property.

4. The liquid jet head according to claim 1, wherein the terminal section is formed as a mounting electrode connected to the lower electrode, and the lower electrode and the mounting electrode are connected to the adhesive area or the outside of the adhesive area.

5. A liquid jet apparatus comprising the liquid jet head according to claim 1.

* * * * *